US007377772B2

(12) United States Patent
Thune et al.

(10) Patent No.: US 7,377,772 B2
(45) Date of Patent: May 27, 2008

(54) FILLED/CONTAINERIZED CANDLE LID AND BURN CONTROL DEVICE

(75) Inventors: Gregory R. Thune, Westerville, OH (US); James P. Wang, Lancaster, OH (US); Jeffrey D. Accursi, Westerville, OH (US)

(73) Assignee: Anchor Hocking Operating Company, LLC, Lancaster, OH (US)

( * ) Notice: Subject to any disclaimer, the term of this patent is extended or adjusted under 35 U.S.C. 154(b) by 0 days.

(21) Appl. No.: 10/813,364

(22) Filed: Mar. 31, 2004

(65) Prior Publication Data

US 2005/0079466 A1 Apr. 14, 2005

Related U.S. Application Data

(60) Provisional application No. 60/509,939, filed on Oct. 10, 2003, provisional application No. 60/531,969, filed on Dec. 24, 2003.

(51) Int. Cl.
*F23D 3/08* (2006.01)
*F21V 35/00* (2006.01)
*F21V 37/02* (2006.01)

(52) U.S. Cl. ..... 431/291; 431/289; 362/161; 422/125

(58) Field of Classification Search ..... 126/43–45; 431/291, 289; 422/125; 362/161
See application file for complete search history.

(56) References Cited

U.S. PATENT DOCUMENTS 358,505 A * 3/1887 Tatum ..... 108/138
383,862 A * 6/1888 Clarke ..... 362/163
426,802 A * 4/1890 Hammer ..... 126/43
821,406 A * 5/1906 Ernst ..... 126/43
1,010,461 A * 12/1911 Smith ..... 431/342
1,029,757 A * 6/1912 Jeavons ..... 431/341
1,038,028 A * 9/1912 Tremper ..... 431/146
1,045,547 A * 11/1912 Hamilton ..... 431/342
1,052,984 A 2/1913 Thomson
1,067,981 A * 7/1913 Hamilton ..... 431/341
1,104,383 A * 7/1914 Potter ..... 431/341
1,165,326 A * 12/1915 Dunn ..... 431/146
1,170,606 A * 2/1916 Chadwick ..... 431/201
1,226,625 A * 5/1917 Bail ..... 431/331
1,267,475 A * 5/1918 Strobl ..... 431/146
1,365,074 A * 1/1921 Alvarez et al. ..... 431/146
1,446,353 A * 2/1923 Slocum ..... 431/341
1,601,677 A 9/1926 Csareo
1,705,877 A * 3/1929 Ramsey ..... 362/161
1,879,954 A * 9/1932 Smith ..... 126/43

(Continued)

FOREIGN PATENT DOCUMENTS

DE 26 18 394 * 1/1978

(Continued)

*Primary Examiner*—Carl D Price
(74) *Attorney, Agent, or Firm*—Dinsmore & Shohl LLP

(57) ABSTRACT

A candle container with a holder and burn control cover. The burn control cover and holder are configured in such a manner to create air intake vents for more efficient burning of a candle. The burn control cover includes a lower ring and an exhaust hole. A removable fitment attaches to the burn control cover through the exhaust hole for safe shipping and sealing of the candle container. A wax warmer container may attach to the candle container for scent distribution.

25 Claims, 15 Drawing Sheets

U.S. PATENT DOCUMENTS

| | | | | | |
|---|---|---|---|---|---|
| 1,879,955 | A | * | 9/1932 | Smith | 126/43 |
| 1,890,378 | A | | 12/1932 | Godoy | |
| 1,975,496 | A | | 10/1934 | Barrett, Jr. | |
| 2,072,692 | A | | 3/1937 | Valle | |
| 2,080,251 | A | * | 5/1937 | Buskard | 362/163 |
| 2,134,759 | A | * | 11/1938 | Howlett | 220/231 |
| 2,189,746 | A | | 2/1940 | Candy, Jr. | |
| 2,214,991 | A | | 9/1940 | Candy, Jr. | |
| 2,237,523 | A | | 4/1941 | Damon | |
| 2,254,664 | A | | 9/1941 | Quinlan | |
| 2,312,640 | A | * | 3/1943 | Guilfoil, Jr. | 431/146 |
| 2,371,410 | A | * | 3/1945 | Rickenbacher | 126/261 |
| 2,668,993 | A | * | 2/1954 | Bair | 422/125 |
| 3,051,159 | A | * | 8/1962 | Hardy | 126/25 A |
| 3,315,723 | A | * | 4/1967 | Eskey et al. | 431/206 |
| 3,493,314 | A | | 2/1970 | Krance et al. | |
| 3,502,068 | A | * | 3/1970 | Henson | 126/262 |
| 3,697,739 | A | | 10/1972 | Novak et al. | |
| 3,767,910 | A | | 10/1973 | Harrigan | |
| 4,186,430 | A | | 1/1980 | Britton | |
| 4,380,992 | A | * | 4/1983 | Spring | 126/43 |
| 4,781,895 | A | * | 11/1988 | Spector | 422/125 |
| 4,926,298 | A | * | 5/1990 | Zimmerman | 362/163 |
| 5,584,283 | A | * | 12/1996 | Messina | 126/43 |
| 5,879,151 | A | | 3/1999 | Schultz et al. | |
| 5,881,905 | A | * | 3/1999 | Brady | 220/573.1 |
| 6,231,336 | B1 | | 5/2001 | Chen | |
| 6,382,962 | B1 | | 5/2002 | Papai | |
| 6,585,510 | B2 | * | 7/2003 | Papai | 431/291 |
| 6,589,047 | B1 | * | 7/2003 | Papai | 431/291 |
| 6,629,836 | B2 | * | 10/2003 | Campbell | 431/33 |
| 2002/0031739 | A1 | | 3/2002 | Papai | |
| 2003/0129558 | A1 | | 7/2003 | Papai | |

FOREIGN PATENT DOCUMENTS

| | | |
|---|---|---|
| DE | 86 10 528.0 | 4/1986 |
| DE | 88 14 266.3 | 11/1988 |
| DE | 90 03 752.9 | 3/1990 |
| DE | 93 11 551.2 | 8/1993 |
| SI | 20101 | 9/1998 |

* cited by examiner

FILLED/CONTAINERIZED CANDLE LID AND BURN CONTROL DEVICE

CROSS-REFERENCE TO RELATED APPLICATIONS

This application relates to U.S. Provisional Patent Application No. 60/509,939 filed on Oct. 10, 2003, and U.S. Provisional Patent Application No. 60/531,969 filed on Dec. 24, 2003, the contents of which are hereby incorporated by reference herein in their entirety.

FIELD OF THE INVENTION

The present invention relates to containerized candles with burn control covers utilizing air intake vents. Additionally, the present invention relates to wax warmer containers for use with a burn control cover and containerized candle.

BACKGROUND OF THE INVENTION

Conventional containerized candles have a candle inside a container and a lid. Typically, the lid is not attached to the container while the candle is burning. Consequently, the consumer usually discards the lid after purchase as it no longer has any use or value to them.

Conventional containerized candles may break easily while being shipped or processed before purchase by the consumer. Conventional containerized can also lack the ability to properly isolate the fragrance of the candle. Conventional containerized candles have included plastic fitments permanently attached to the lid or holder for safer shipping. However, these permanently attached fitments may disturb the aesthetic value of the candle. In particular, the conventional fitments are sometimes a milky white color, preventing the consumer from fully enjoying the color of the candle.

Another drawback of prior containerized candles relates to accessories that are intended to control burning. It is well known that an open flame in a house can be dangerous. Surrounding objects can catch fire from unenclosed flames. Additionally, a flame can also burn out easily from currents in the air. In view of these concerns, containerized candles have added burn control accessories. Typically, the burn control accessories are made of ceramic or metal, such as described in U.S. Pat. Nos. 6,382,962 B1 and 6,589,047 B1 (the respective disclosures of which are both hereby incorporated be reference in their entireties). Ceramic or metal material, however, does not allow for the candle to illuminate the surrounding environment. More specifically, these conventional burn control accessories are generally opaque and thus block and/or absorb light from the candle Conventional containerized candles have also included lids or shades to enhance the appearance of the containerized candle and reduce the affect of drafts upon the flame. Such conventional containerized candles, however, do not increase the overall burn efficiency of the candle. Some conventional burn control accessories may utilize a baffling intake system. A baffling intake system, however, can cause turbulence inside the candle container, resulting in less efficient burning. Consequently, there is a need for a containerized candle and burn control accessory that result in efficient burning of a candle, and provide a pleasing aesthetic appearance.

SUMMARY OF THE INVENTION

Among other features, it will be appreciated that a containerized candle with burn control cover and a removable fitment according to the invention provides for convenient and safe shipping. It also seals and isolates the fragrance of a candle. Further, a burn control cover according to the invention provides for more stable and efficient burning of a containerized candle. It also enhances the light characteristics of the containerized candle.

According to one aspect of the present invention, a candle container includes a holder with a top rim, a burn control cover with a top surface and a rim, and a fitment that is removably attached to the burn control cover. The burn control cover also includes an exhaust hole and a lower ring that extends vertically down from an interior surface of the burn control cover. The burn control cover is configured in such a manner that it is removably attached to the top rim of the holder. Air is vented into the holder at the circumference of the rim of the holder because of the configuration of the burn control cover and holder. The lower ring is disposed on the burn control cover so as to extend below the top rim of the holder when the burn control cover is attached to the holder. The burn control cover may also include more than one exhaust hole.

According to another feature of the present invention, the candle container is preferably made out of glass.

According to another feature of the present invention, the fitment is removably attached to the burn control cover through the exhaust hole by an undercut of the exhaust hole on an interior surface of the burn control cover. The fitment has an outer rim in a shape corresponding to the rim of the burn control cover or the holder.

According to an embodiment of the present invention, the burn control cover preferably includes protrusions on the bottom side of the rim of the burn control cover, and the holder includes corresponding notches in the top rim of the holder that vary in depth to allow the protrusions sit in the notches. A deeper notch allows for the burn control cover to attach flush against the holder, a middle depth notch allows for air to pass between the burn control cover and the holder and a more shallow notch allows for more air to pass between the burn control cover and the holder. The number and size of protrusions and notches may vary to alter the amount of air able to flow between the burn control cover and the holder.

According to another embodiment of the present invention, the rim of the burn control cover includes peaks and troughs that create air intake vents in the rim of the burn control cover at the troughs, and air flows through the air intake vents and into the holder.

The rim of the holder preferably includes similar peaks and troughs that create air intake vents in the rim of the holder at the troughs so that air flows through the air intake vents and into the holder.

According to another aspect of the present invention, the lower ring extends below the top rim of the holder, leaving a gap of space between the top rim of the holder and the lower ring. The gap allows for air to enter into the holder. The lower ring is a smooth shape allowing for channeling of air down the perimeter of the holder to feed the flame of the candle. The heated air rises up to the inside portion of the ring and out of the exhaust hole(s). This air intake system promotes more uniform wax burning since it also traps a volume of hot air within the container to aid in the melting of perimeter wax to feed the wick.

According to another aspect of the present invention, a plurality of standoff tabs may be positioned on an underside of the rim of the burn control cover.

According to an embodiment of the present invention, the holder includes a top rim and the burn control cover includes a top surface and a rim. The burn control cover is configured in such a manner to be removably attached to the top rim of the holder. The burn control cover and holder are configured to vent air into the holder at the circumference of the rim of the holder, and the lower ring is disposed on the burn control cover so as to extend below the top rim of the holder when the burn control cover is attached to the holder. The burn control cover includes multiple exhaust holes and a lower ring that extends vertically down from an interior surface of the burn control cover, and the burn control cover includes a locking hole for attaching an accessory, such as a wax warmer container. The embodiment preferably includes a wax warmer container that includes a key lock stud for locking the wax warmer into the key lock hole of the burn control cover.

According to another embodiment of the present invention, the burn control cover includes an upwards extending threaded part. The embodiment also includes a wax warmer container that includes a downward extending matching threaded part for attaching the wax warmer to the burn control cover. The matching threaded part screws in to the threaded part of the burn control cover. The wax warmer container includes one or more scent wells.

According to an embodiment of the present invention the burn control cover includes a top surface, a rim, an exhaust hole through the center portion of the burn control cover, and a lower ring that extends in a vertical direction down from an interior surface of the burn control cover. The top surface of the burn control cover includes a well for scent warming. The top surface may include any suitable number of wells.

According to the present invention, a containerized candle with a burn control cover and a removable fitment may provide easy and safe shipping and sealing and isolating of a fragrance. A containerized candle burn control cover may add value to the product after purchase. A burn control cover may provide a more stable and efficient burning of a containerized candle and may enhance of the light characteristics of the containerized candle. A containerized candle and burn control cover may increase the options of the consumer in using the containerized candle.

These and other features, aspects, and advantages of the present invention will become apparent from the following description, appended claims, and the accompanying exemplary embodiments shown in the drawings, which are briefly described below.

It is to be understood that both the foregoing general description and the following detailed description are exemplary and exemplary only, and are not restrictive of the invention as claimed.

DETAILED DESCRIPTION

Figure 1:
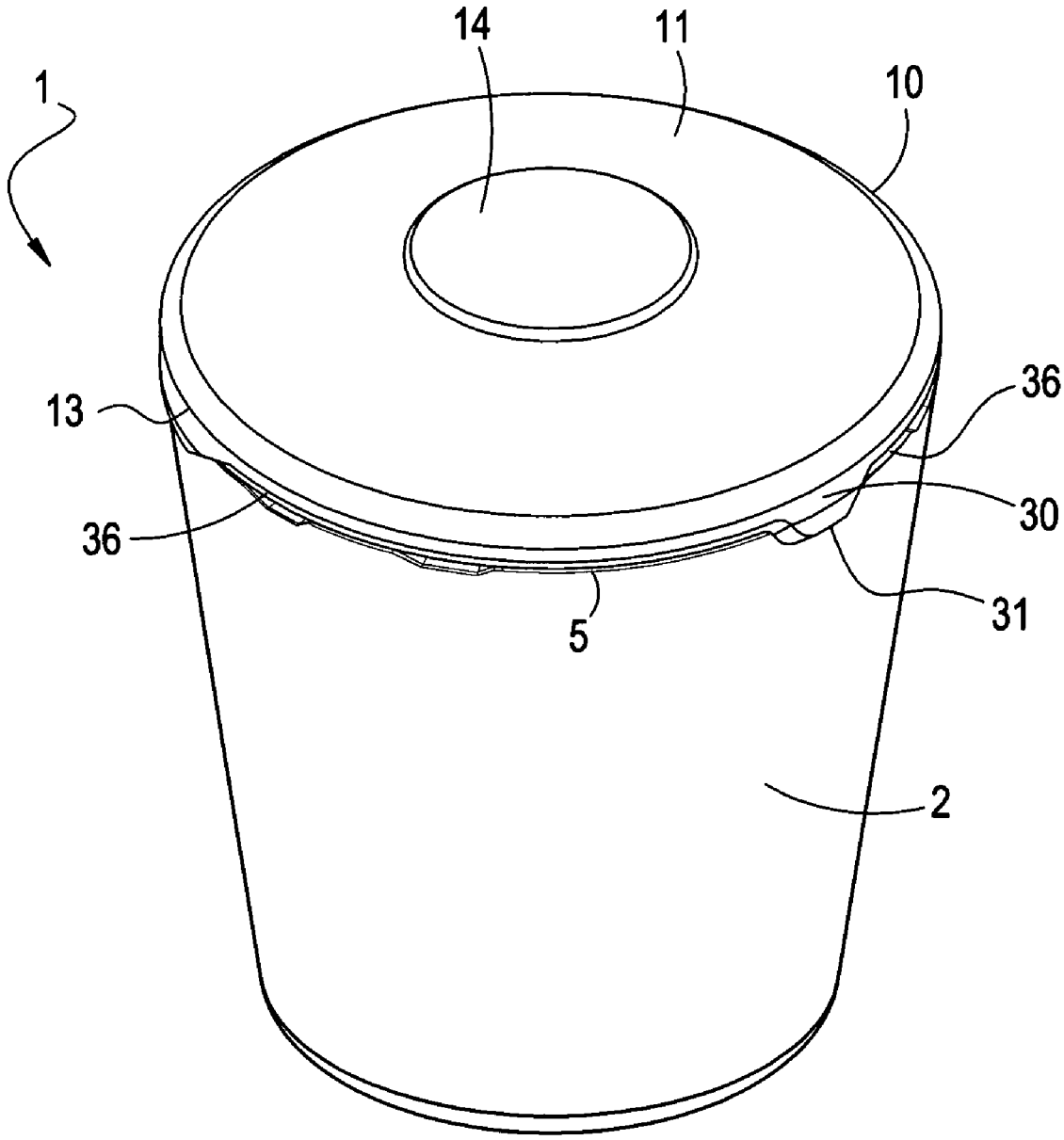
FIG. 1 is a perspective view of an embodiment of a candle container according to the present invention.
Figure 2:
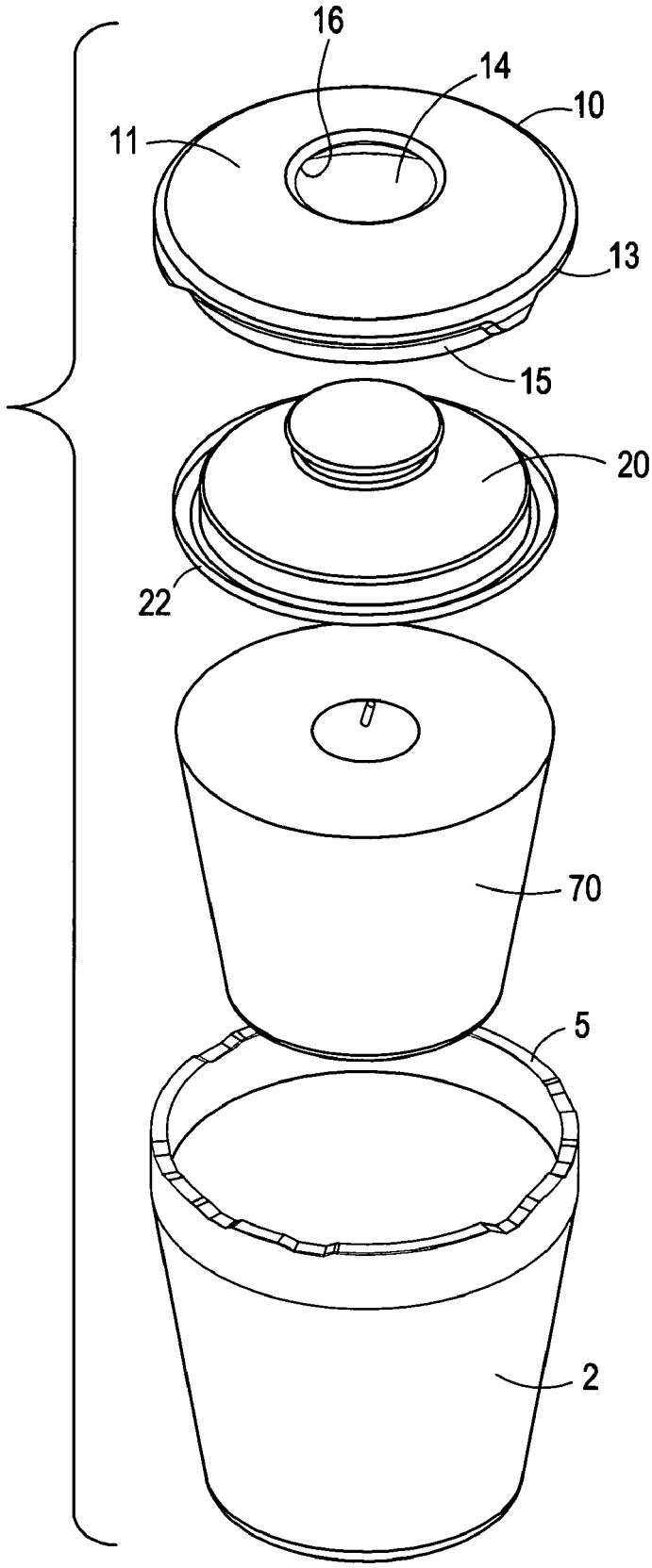
FIG. 2 is an exploded view of the candle container of FIG. 1.
Figure 3:
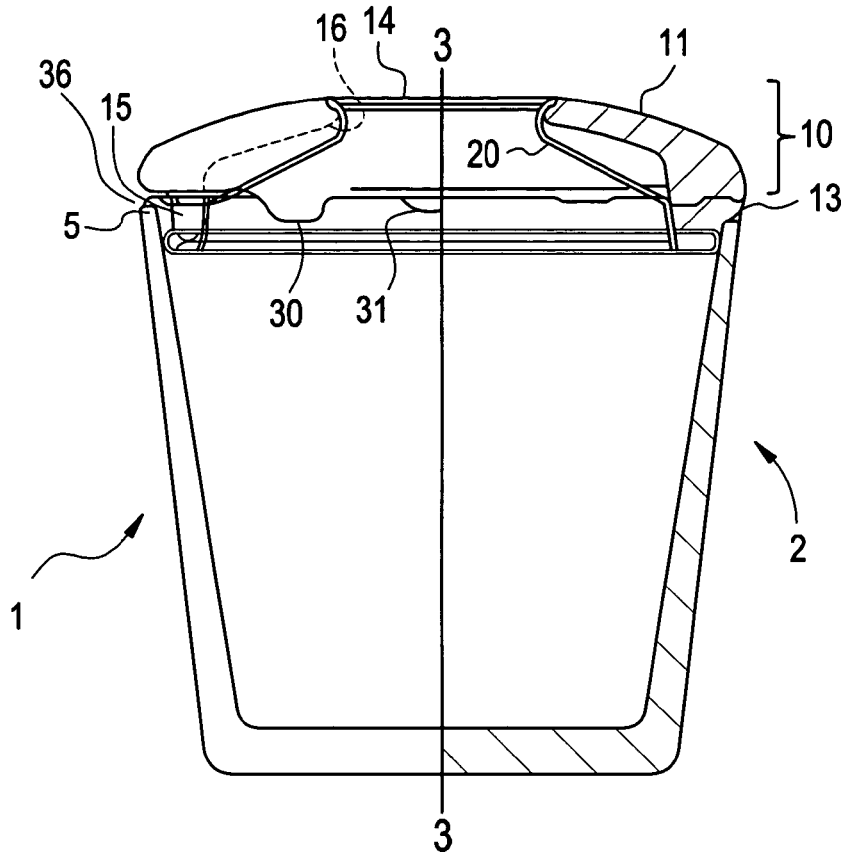
FIG. 3 is a side view of the candle container of FIG. 1.
Figure 4:
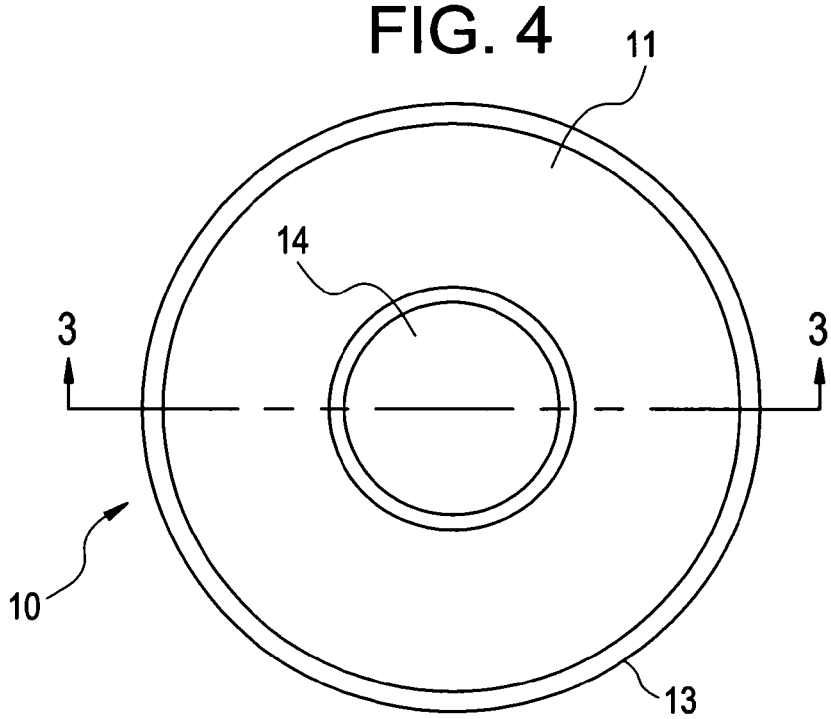
FIG. 4 is a top view of a burn control cover of FIG. 1.

Hereinafter, embodiments of the present invention will be described with reference to the attached drawings.

FIGS. 1-9 illustrate a candle container according to a first embodiment. The candle container 1 of FIG. 1 comprises a burn control cover 10 removably attached to a holder 2. The holder 2 includes a top rim 5. A candle 70 is preferably situated inside the holder 2 for burning. The burn control cover 10 includes a top surface 11 and a rim 13. The burn control cover 10 is removably attached to the holder 2, so that when a candle 70 is lit inside the holder, the burn control cover 10 can improve the efficiency of the burning of the candle and enhanced aesthetic appearance. An exhaust hole 14 through the center of the burn control cover 10 allows hot air from a flame of a candle 70 or the like to exit. The burn control cover 10 and the holder 2 are configured to vent air into the holder 2 at the circumference of the rim 5 of the holder 2 by the air intake vents 36.

Figure 5:
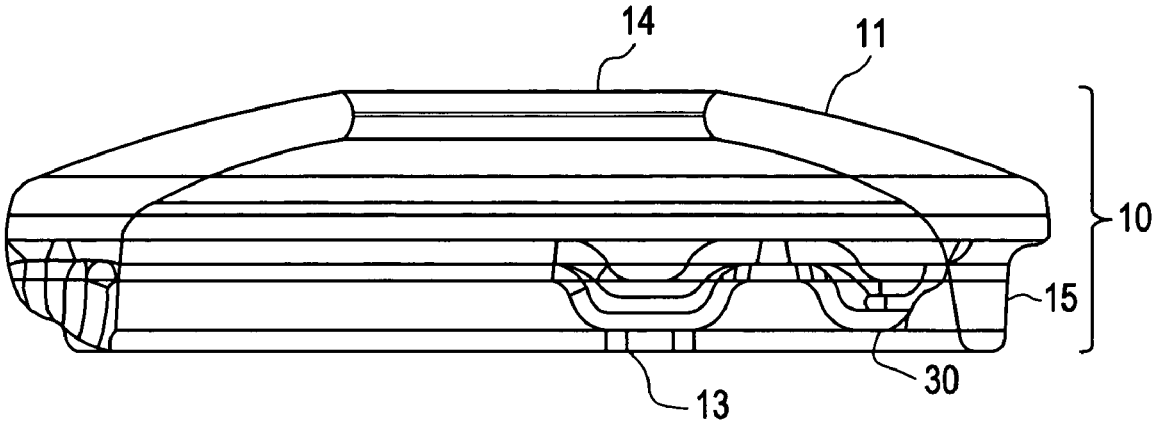
FIG. 5 is a side view of a burn control cover of FIG. 1.
Figure 10:
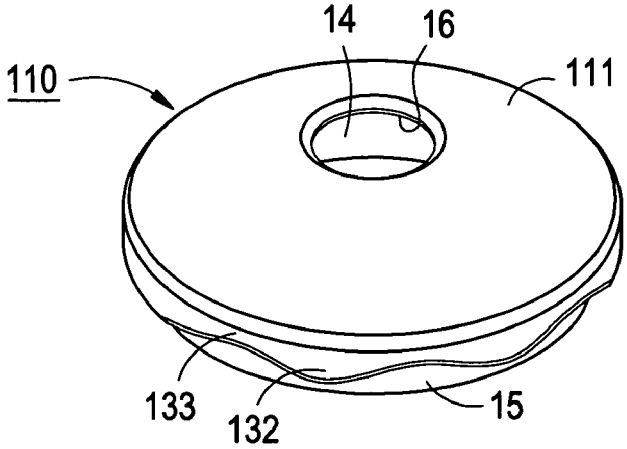
FIG. 10 is a perspective view of the burn control cover of FIG. 9.
Figure 11:
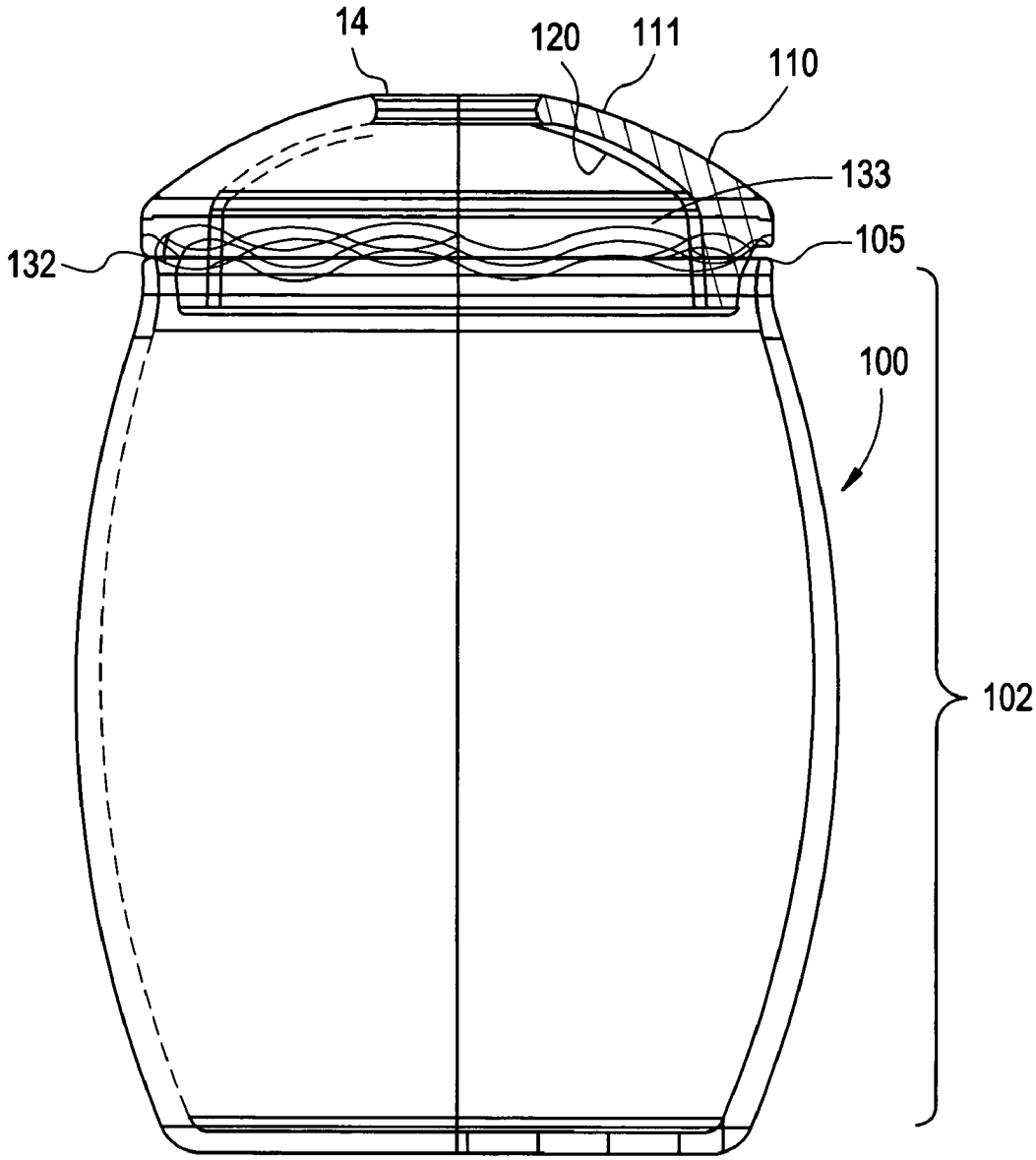
FIG. 11 is a side view of the candle container of FIG. 9.
Figure 12:
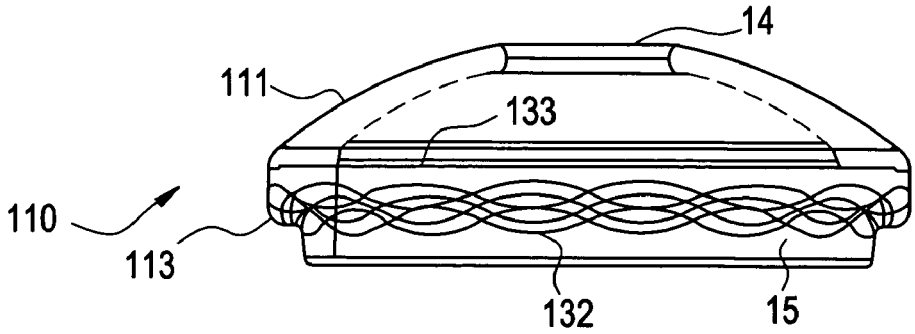
FIG. 12 is a side view of the burn control cover of FIG. 9.

A lower ring 15, as can be seen in FIGS. 5 and 10, extends vertically down from an interior surface 12 of the burn control cover 10. The lower ring 15 is disposed on the burn control cover 10 in such a manner that when the burn control cover 10 is attached to the holder 2, the lower ring 15 extends below the top rim 5 of the holder 2. The lower ring 15 separates the intake air from the exit air and provides a stable curtain of air that minimizes turbulence around the flame. A stable flame burns more efficient than one that moves. While one exhaust hole 14 is shown, the burn control cover 10 may include more than one exhaust hole.

Figure 8:
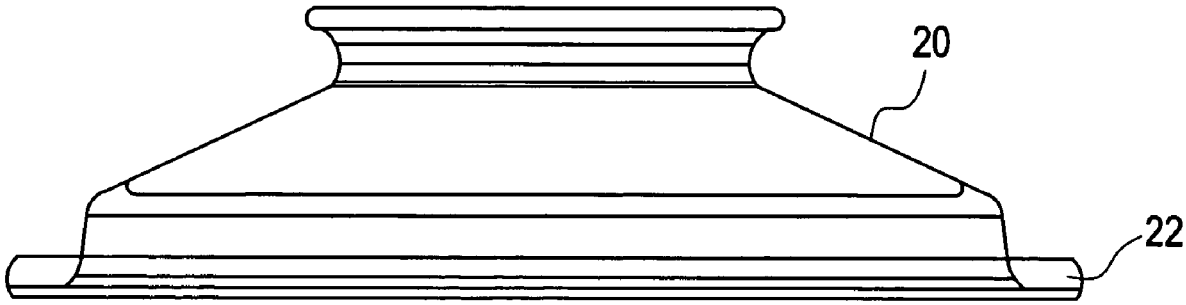
FIG. 8 is a side view of a fitment of a candle container, according to the invention.
Figure 9:
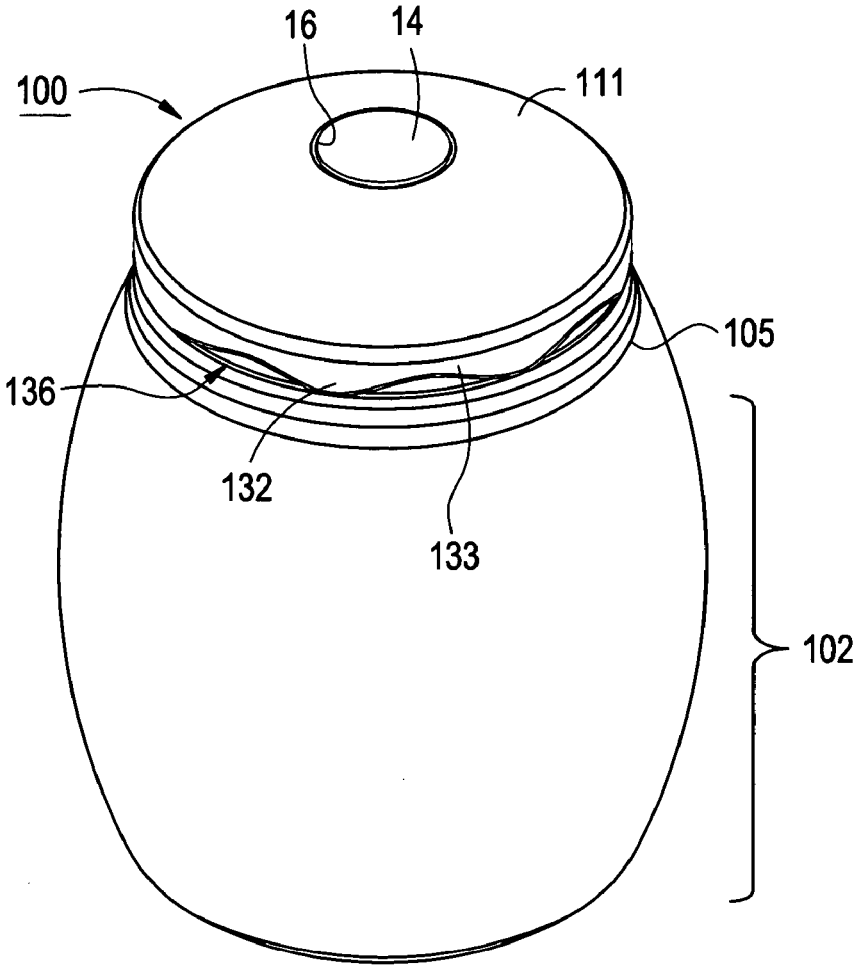
FIG. 9 is a perspective view of another embodiment of the candle container according to the present invention.

As shown in FIG. 8, a fitment 20 is removably attached to the burn control cover 10. The fitment 20 is designed to be removable by a customer before use. The fitment 20 attaches through the exhaust hole 14 in the burn control cover 10. The exhaust hole 14 includes an undercut 16 on which the fitment 20 attaches. The fitment 20 has an outer rim 22 configured in a shape corresponding to the rim 13 of the burn control cover 10. The fitment 20 helps the candle container 1 to be safely shipped and sealed. The fitment 20 is attached to the burn control cover 10, which is then attached to the holder 2 during storage or shipping. The customer may then remove the fitment 20 from the burn control cover 10, allowing the burn control cover 10 to be attached to the holder 2 without disturbing any aesthetic value of the candle container 1. The lower ring 15 ensures that the fitment 20 is properly located in reference to the burn control cover 10 and holder's 2 sealing surfaces.

The holder is preferably made of glass for better aesthetic value, allowing sufficient light to shine through the holder from the flame of the candle. Other suitable materials known in the art may also be used.

Figure 6:
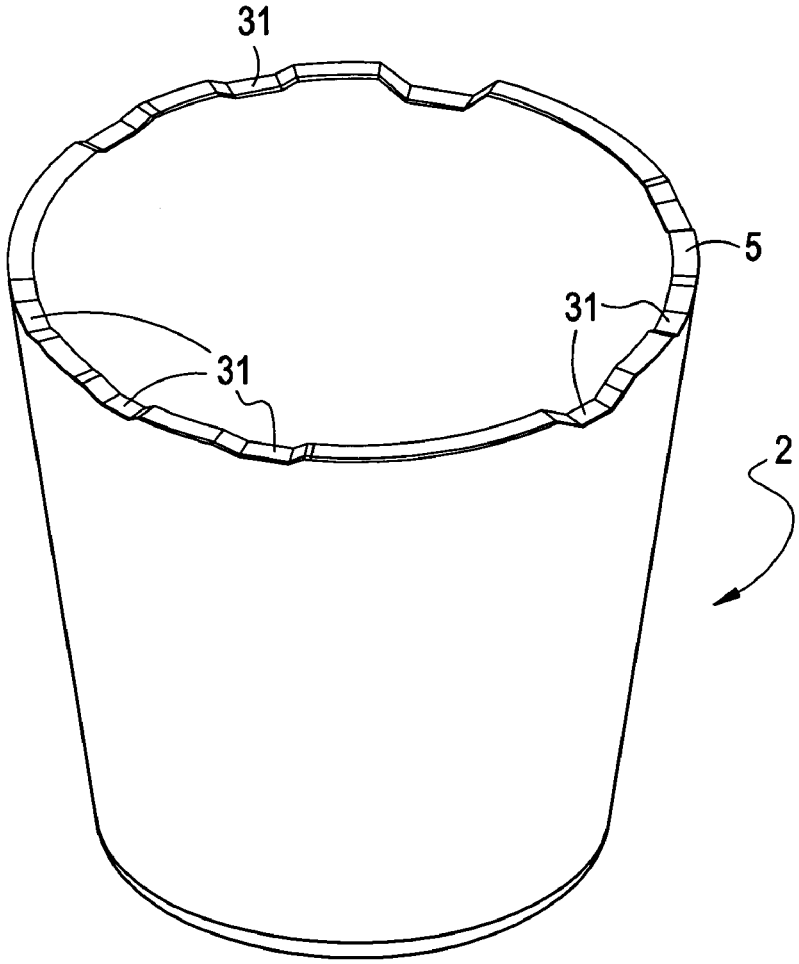
FIG. 6 is a view of a holder of the candle container of FIG. 1.
Figure 7:
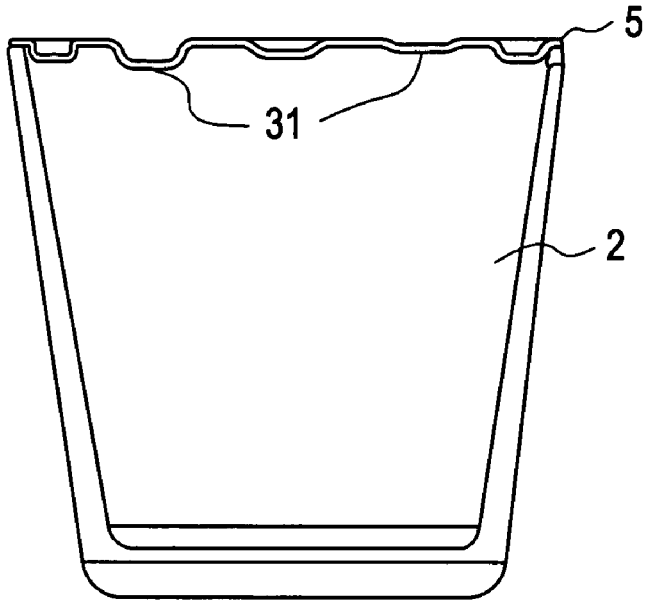
FIG. 7 is a side view of the holder of FIG. 1.

As shown in FIGS. 2-7, the holder 2, of this embodiment has notches 31 corresponding to protrusions 30 on the burn control cover 10 that create air intake vents 36. The holder 2, as shown in FIGS. 6 and 7, includes notches 31 in the top rim 5 that vary in depth. The burn control cover 10, as can be seen in FIG. 5, includes protrusions 30 that extend down in a vertical direction from the rim 13 of the burn control cover 10. The protrusions 30 correspond to the notches 31 of the holder 2. By attaching the burn control cover 10 to the holder 2 with the protrusions 30 and notches 31, various amounts of air enters into the holder 2. The amount of air flowing into the candle container 1 is adjustable. By disposing the protrusions 30 into the deepest notches 31, the burn control cover 10 will attach flush with the holder 2. By disposing the protrusions 30 into more shallower notches 31, air intake vents 36 are created and the amount of air allowed to enter the holder 2 is increased. The number and size of the protrusions 30 and notches 31 may vary in order to alter the flow of air into the candle container 1.

The air intake vents 36 are utilized such that outside air enters the air intake vents 36 and travels down into the holder 2 between the lower ring 15 and a wall of the holder 2. The air then feeds the flame of a candle 70 and the hot air flows up the center of the lower ring 15 and out of the candle container 1 through the exhaust hole 14 in the burn control cover 10.

FIGS. 9-12 show a second embodiment of a candle container 100 in which the air intake vents 136 may be created by configuring the burn control cover 110 to have a rim 113 of a design including peaks 132 and troughs 133. The burn control cover 110 attaches to the holder 102 by the peaks 132 disposed on the rim 105 of the holder 102. Air flows into the holder 102 through the troughs 133 down into the holder 102 between the lower ring 15 and a wall of the holder 102. The hot air then flows up the center of the lower ring 15 and out of the candle container 100 through the exhaust hole 14 in the burn control cover 110.

Figure 13:
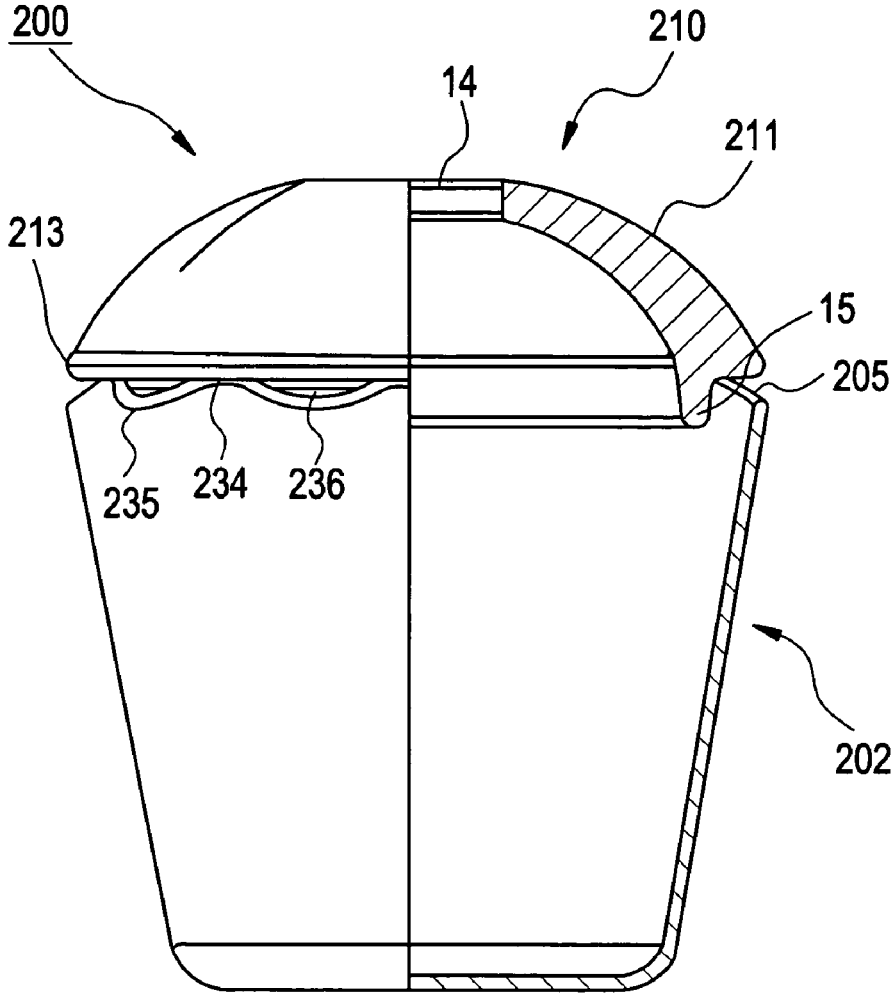
FIG. 13 is a view of another embodiment of the candle container according to the present invention.
Figure 14:
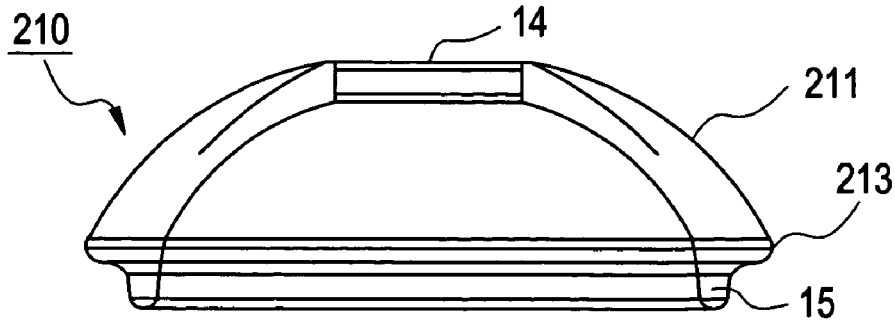
FIG. 14 is a side view of the burn control cover of FIG. 13.
Figure 15:
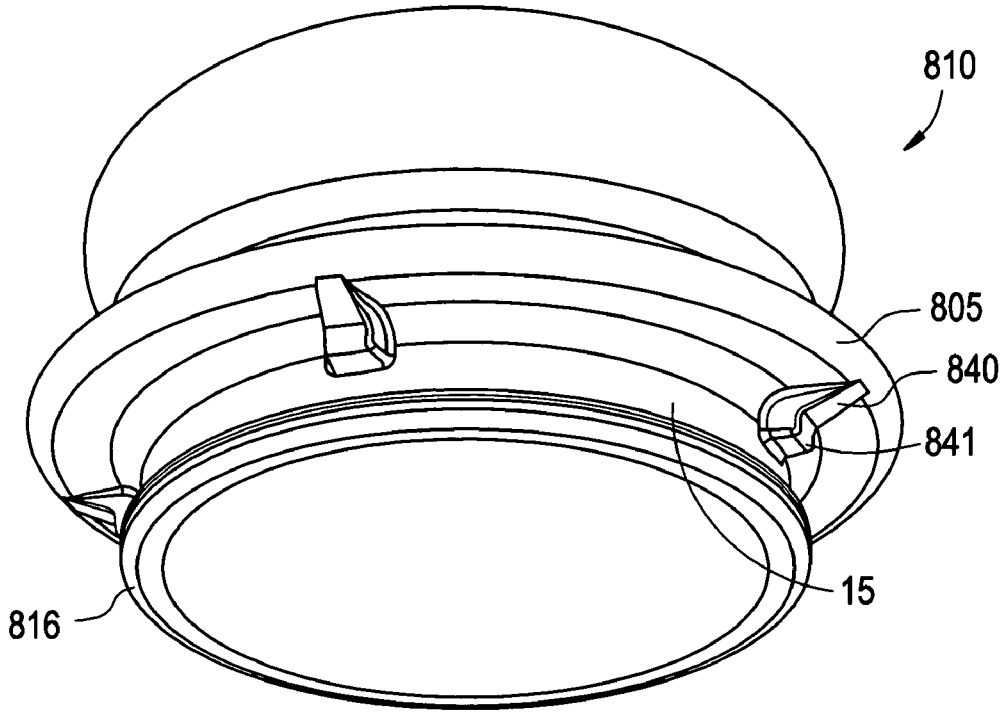
FIG. 15 is a perspective view of another embodiment of the candle container of the present invention.
Figure 16:
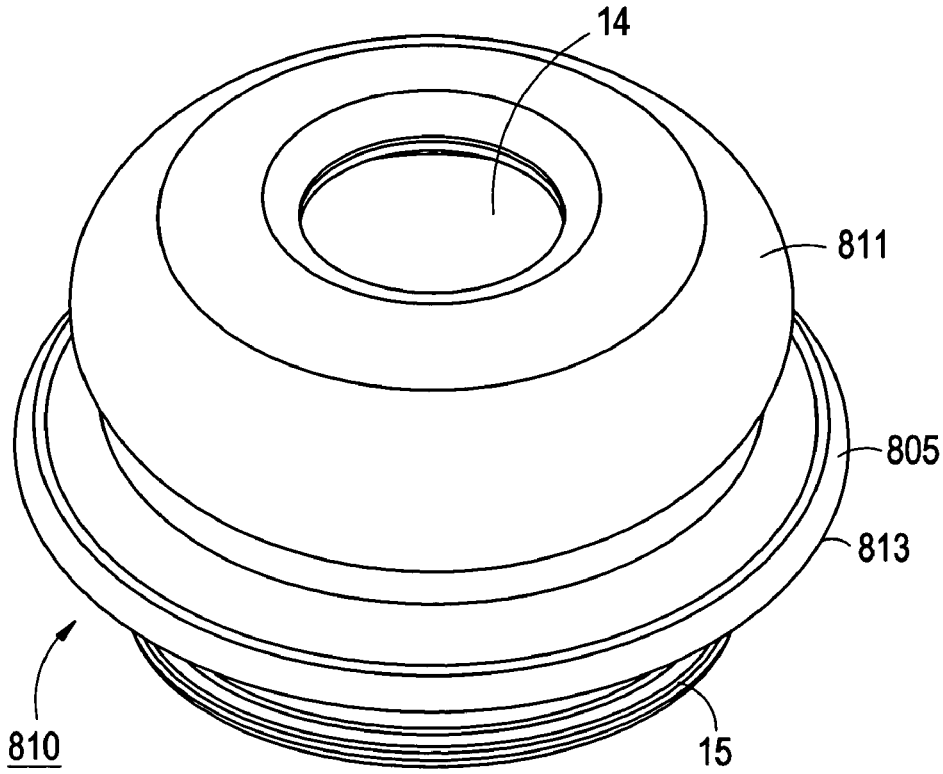
FIG. 16 is a perspective view of the candle container of FIG. 15.
Figure 17:
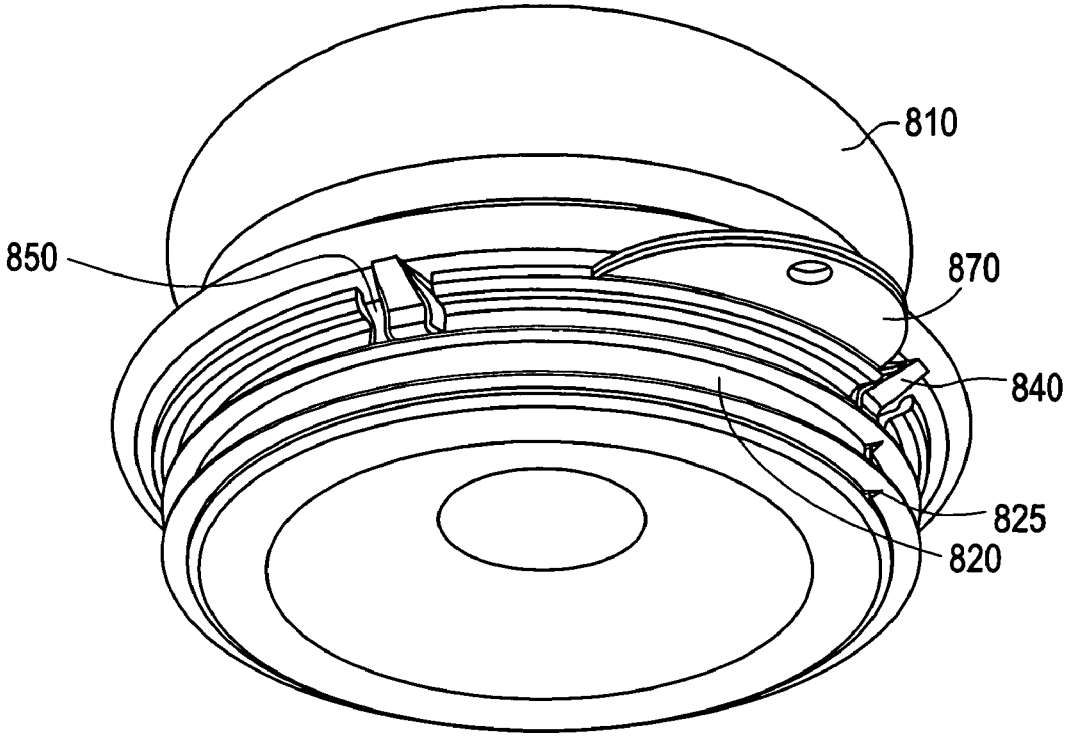
FIG. 17 is a perspective view of the burn control cover and fitment of FIG. 15.

FIGS. 13 and 14 show an alternative embodiment of the candle container 200 in which the air intake vents 236 are preferably created by configuring the rim 205 of the holder 202 to be of a design including peaks 234 and troughs 235. The troughs 235 create the air intake vents 236 for the flow of air into the holder 202 between the lower ring 15 and a wall of the holder 202. The air then flows down into the holder 202 to feed the flame of the candle 70, and the hot air flows up a center portion of the lower ring 15 and out of the candle container 200 through the exhaust hole 14 of the burn control cover 210.

The fitment 220 removably attaches to the burn control cover 210 through the undercut 16 of the exhaust hole 14. The fitment 220 is configured to have an outer rim 222 in a shape corresponding to the rim 205 of the holder 202 in order to properly seal the candle container 200 for shipping or storage.

FIGS. 15-20 show a burn control cover 810 according to an alternative embodiment in which the air intake vents 36 are created by a plurality of standoff tabs 840 located on an underside of the rim 805 of the burn control cover 810. The standoff tabs 840 create an air gap between the burn control cover 810 and the holder 2 to create the air intake vents 36. The burn control cover 810 preferably includes three standoff tabs 840. Any other amount suitable for creating air intake vents 36 may also be used.

The standoff tabs 840 are preferably designed in a wedge shape. The wedge shape aids in centering the burn control cover 810 onto the holder 2. The standoff tabs 840 may further include a raised shoulder 841. The raised shoulder 841 limits the amount of movement the burn control cover 810 can vary. These features help ensure the aesthetic alignment of the burn control cover 810 to the holder 2 and the features also ensure maximum burn efficiency. The standoff tabs 840 may be any other suitable shape.

Burn efficiency is achieved with the appropriate size and location of the exhaust hole 14 and a smooth air intake system 36 that separates the intake air from the exhaust air. This particular design configuration is very efficient due to its calm cylinder of intake air on the perimeter and exhaust air column up the middle. Turbulence within the candle container 1 during burning causes inefficient burning and sooting. The lower ring 15 of the burn control cover 810 that extends down into the container produces a very calm air flow pattern and is critical to efficient burning.

Convention fitment 820 attaching systems that snap onto an undercut 816 detail on the lower ring 15 may also be used. Since the burn control cover 810 has an exhaust hole 14, these removable fitments 820 are preferably closed (no hole) by design to seal off the exhaust hole 14. The fitment 820 preferably includes a tear-away feature to allow easy removal of the fitment 820 from the burn control cover 810.

Figure 18:
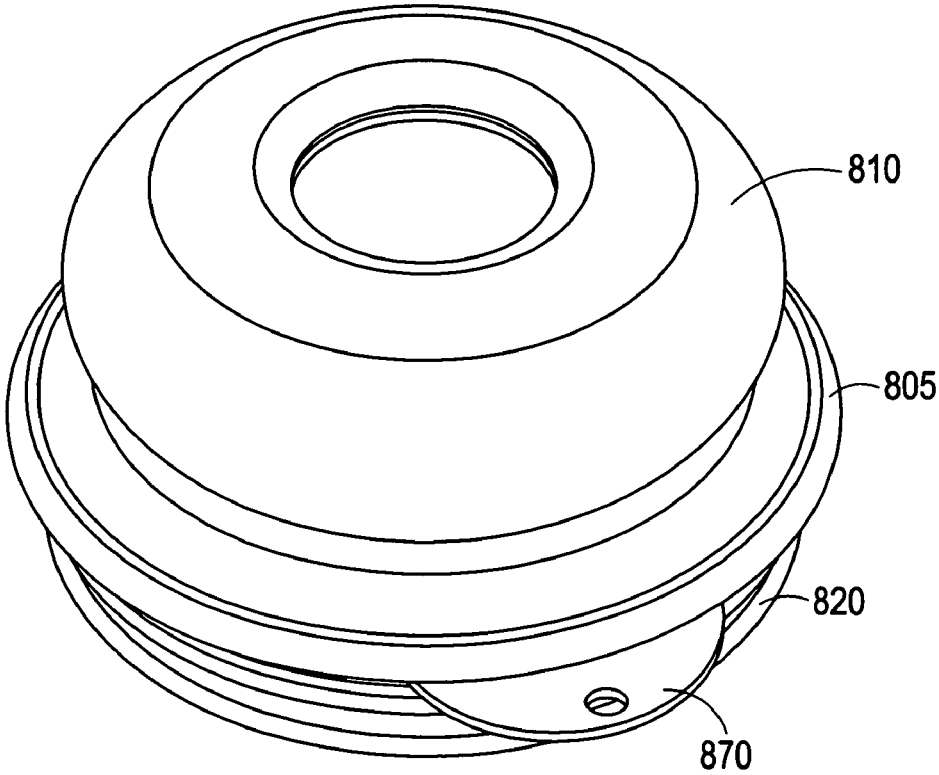
FIG. 18 is a perspective view of the burn control cover and fitment of FIG. 15.

As can be seen in FIG. 18, the removable fitment 820 includes notches or pockets 850 configured to clear the standoff tabs 840 on the burn control cover 810.

Figure 19:
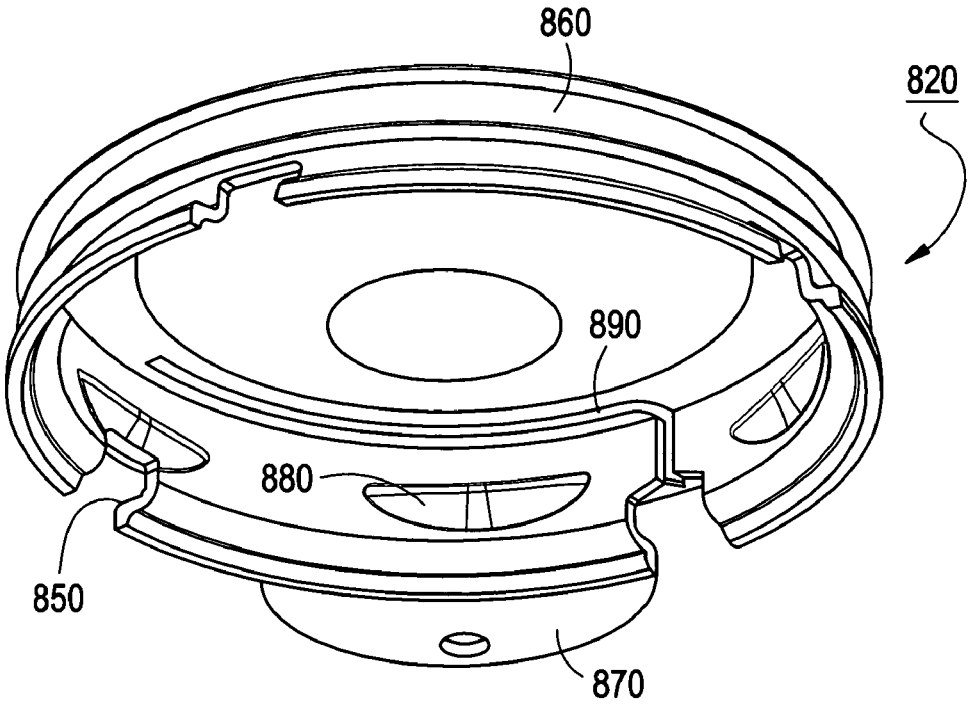
FIG. 19 is a perspective view of the fitment of FIG. 15.
Figure 20:
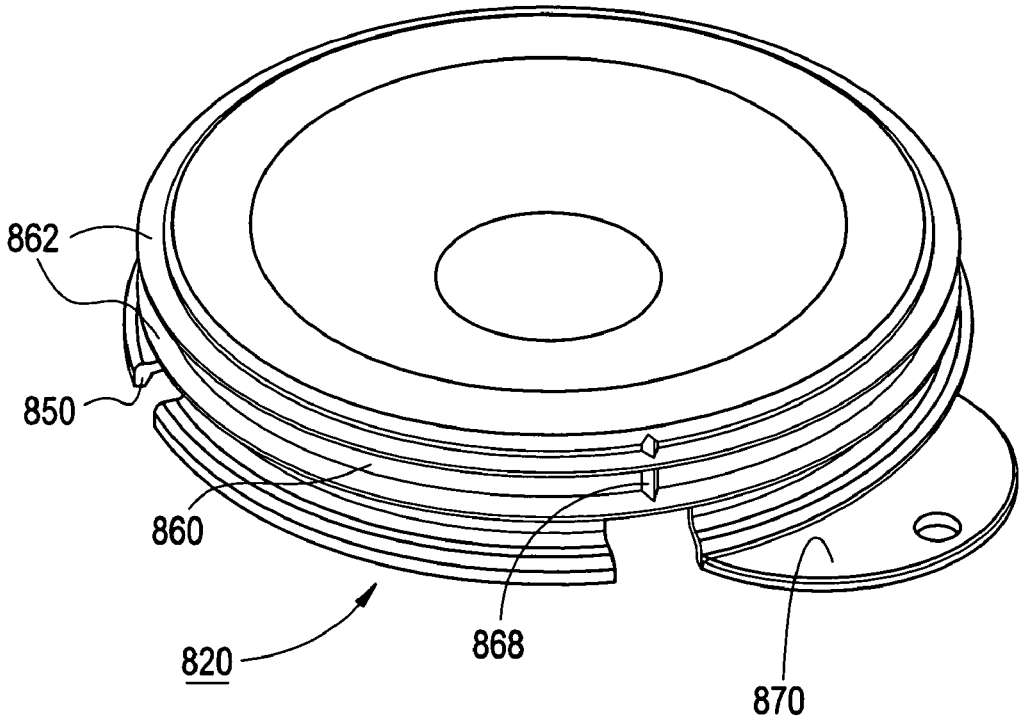
FIG. 20 is a perspective view of the fitment of FIG. 15.

As shown in FIGS. 19 and 20, the fitment 820 preferably includes a void 868 in a side wall 860. The void 868 is the starter section of the tear-away feature. The void 868 also acts as a releasable vent to allow displaced air to escape during candle container 1 assembly. Candle scent may also be vented into the burn control cover 810 by the void 868 in order to smell the scent through the exhaust hole 14 without removing the burn control cover 810. The scent collects in the burn control cover 810.

As shown in FIG. 19, the fitment 820 preferably includes a thinned section 890. The thinned section 890 is the path of the tear-away feature. Undercut lugs 880 are preferably positioned on the inside of the side wall 860. The undercut lugs 880 are configured to lock the fitment 820 to the burn control cover 810. Fins 862 protruding from the side wall 860 are configured to help seal the candle container 1 when the fitment 820 is attached to the burn control cover 820.

As shown in FIGS. 17-20, the fitment 820 further comprises a handle 870. The handle 870 aids in the removal of the fitment 820. The handle 870 allows information tags to be attached and also provides a grip to initiate the tear-away feature for easy fitment 820 removal.

Figure 21:
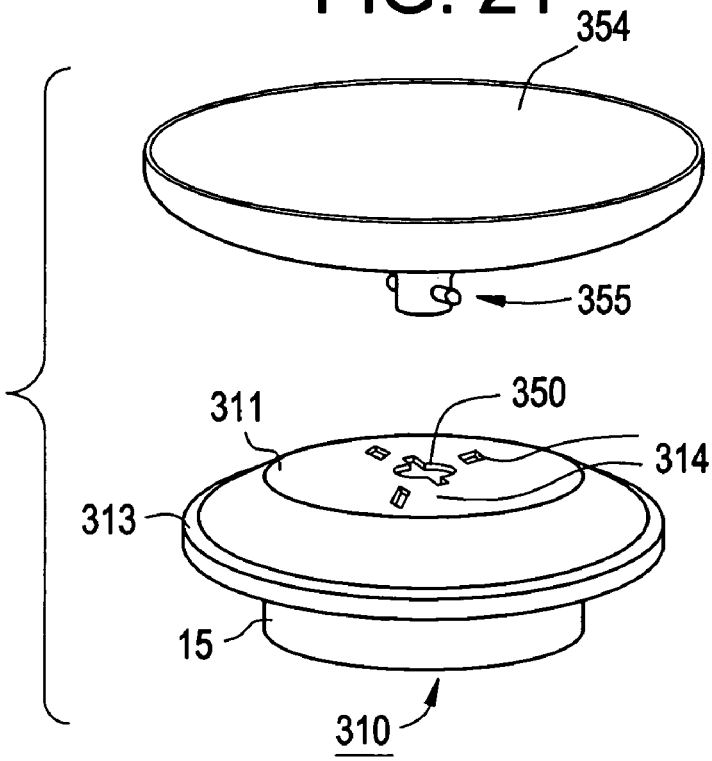
FIG. 21 is a view of another embodiment of the present invention.

FIG. 21 shows a candle container 300 according to an alternative embodiment which includes a locking hole 350 for attaching an accessory, such as a wax warmer 354. The burn control cover 310 includes a top surface 311 and a rim 313. A lower ring 15 also extends vertically down from an interior surface of the burn control cover 310. The burn control cover 310 and holder 302 are configured to vent air through air intake vents 336. The burn control cover 310 includes multiple exhaust holes 314 and a key lock hole 350. A wax warmer container 354 is preferably attached to the burn control cover 310 by means of a key lock stud 355 that extends down in a vertical direction from a center portion of the wax warmer container 354. The key lock stud 355 locks into the key lock hole 350. The wax warmer container 354 includes a scent chamber well 357 or multiple scent chamber wells 357. A scent cube (not pictured) or some other scent diffusing object such as potpourri or oil may be placed on the wax warmer container 354. The heat from the candle 70 flame heats up the scent cube and disperses a scent into the surrounding air.

Figure 22:
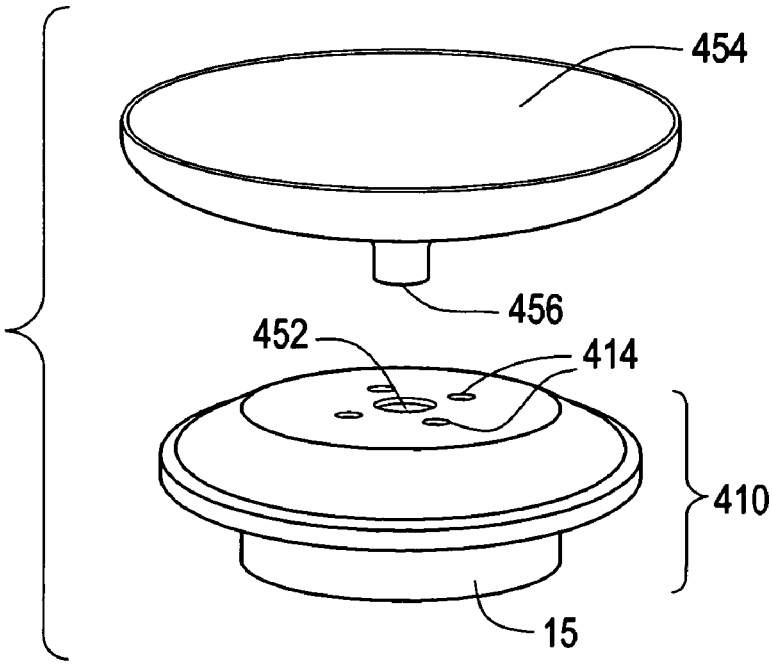
FIG. 22 is a perspective view of the burn control cover of another embodiment of the present invention.
Figure 23:
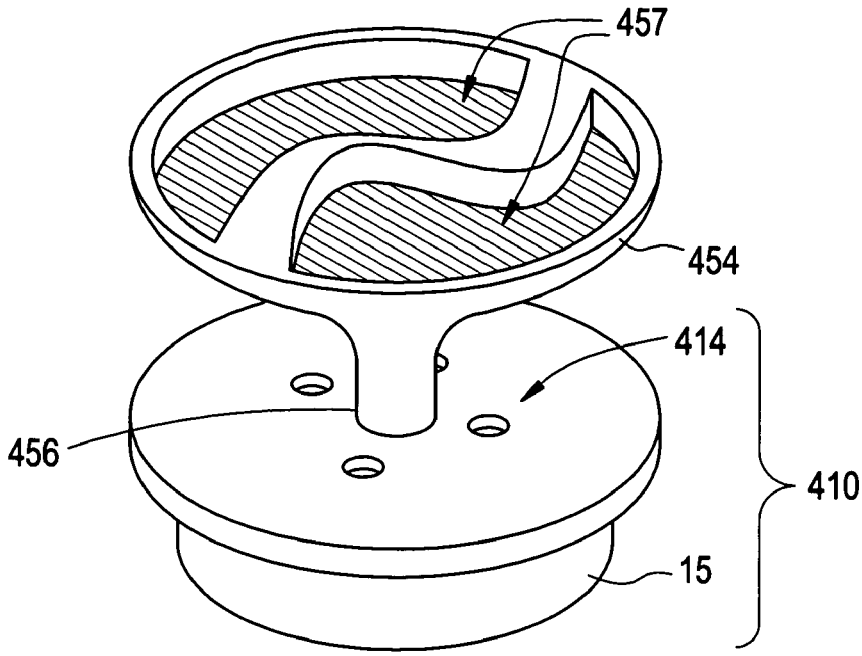
FIG. 23 is a perspective view of the burn control cover of FIG. 22.

FIGS. 22 and 23 show a wax warmer container 454 according to an embodiment in which the wax warmer container is attached to the burn control device 410 by the use of a threaded part 452. A threaded part 452 extends upward in a vertical direction from a center portion of the burn control cover 410. The wax warmer container 454 includes a corresponding matching threaded part 456 that screws into the threaded part 452 of the burn control cover 410. The wax warmer container 454, as seen in FIG. 23, includes scent chamber wells 457. Although two chambers are shown, any suitable number of scent chamber wells may be used. Other suitable accessories, other than a wax warmer container 454, may be attached to the burn control cover 410.

Figure 24:
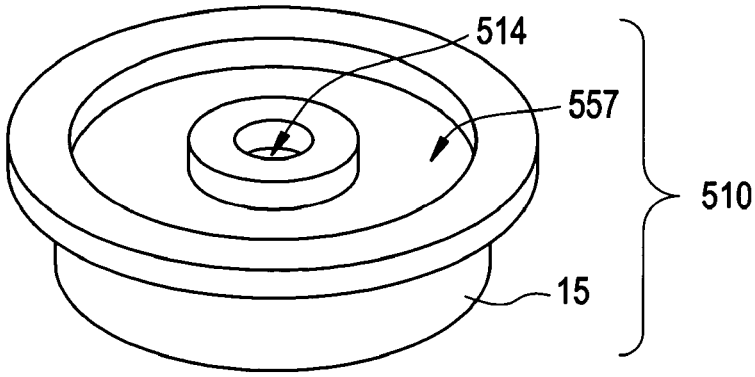
FIG. 24 is a perspective view of another embodiment of the burn control cover of the present invention.
Figure 25:
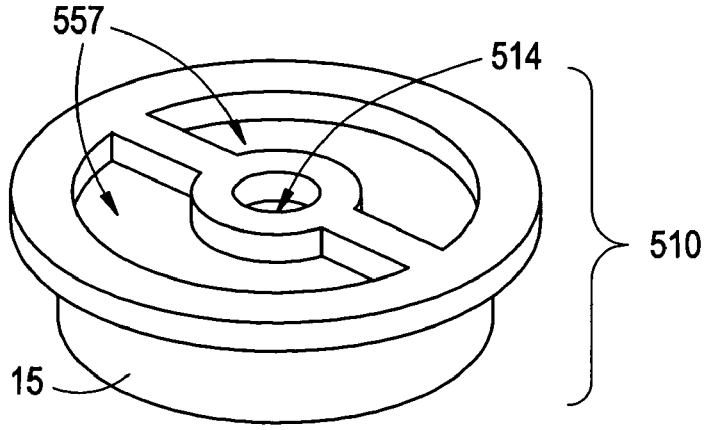
FIG. 25 is a perspective view of the burn control cover of FIG. 24.

According to the embodiments of FIGS. 24 and 25, the burn control cover 510 includes a scent well 557 for distribution of an aroma into the surrounding air. The burn control cover 510 of this embodiment preferably include multiple scent wells 557.

Figure 26:
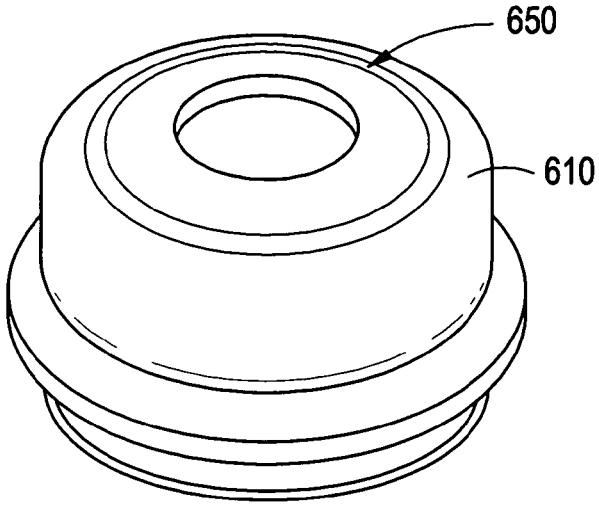
FIG. 26 is a view of another embodiment of the burn control cover of the present invention.
Figure 27:
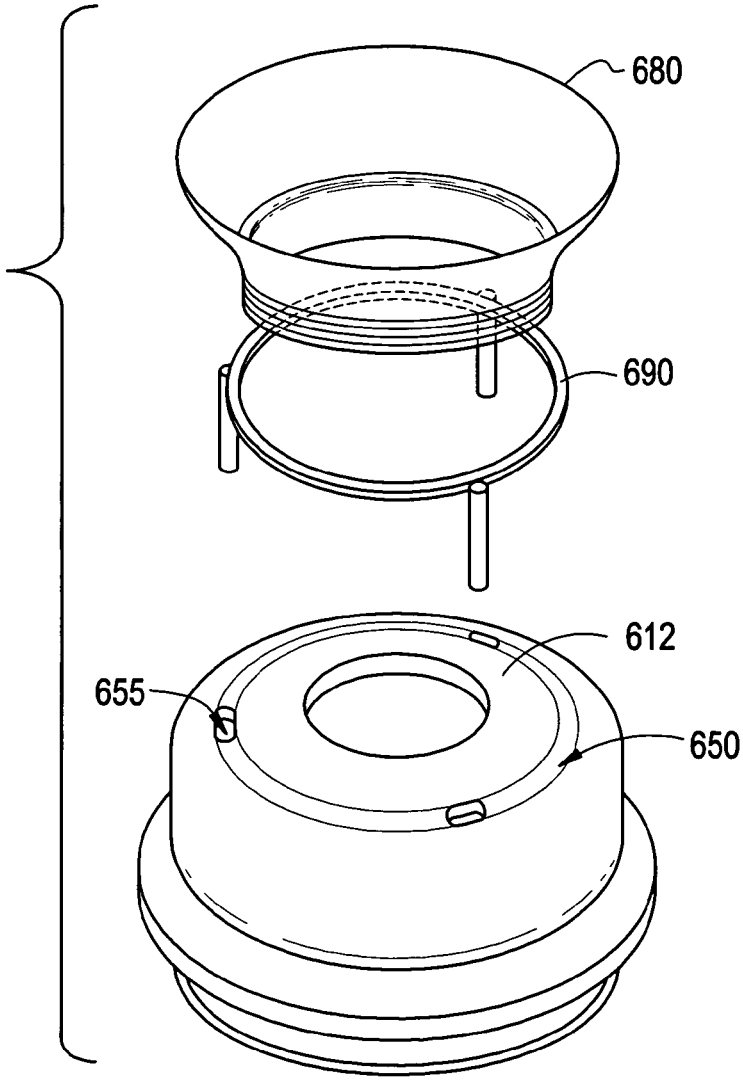
FIG. 27 is a perspective view of the burn control cover of FIG. 26.

The accessories, such as the wax warmer container 454 may be mixed and matched with other accessories and stacked upon each other. For example, as illustrated in FIGS. 26 and 27, the burn control cover 610 preferably includes a stacking detent system. The stacking detent system allows another burn control cover 610 or accessory 680 to be attached. The stacking detent system may be a single ring depression 650, multiple detents 655 on the top surface 612 of the burn control cover 650, or any other suitable stacking system. A wire frame 690 attaches to a burn control cover 610 through a stacking detent ring 650 or detents 655. Other suitable stabilizing and locator systems may be used to stack the accessories. The wire frame 690 may include a propeller or other accessory for aesthetic purposes. The wire frame 690 may hold another burn control cover 610 or accessory 680. The stacking detent system allows for various accessories and covers to be mixed and matched. It will be appreciated that various other embodiments are possible. Fore example, the accessory may be a flower pot or other accessory holder.

Figure 28:
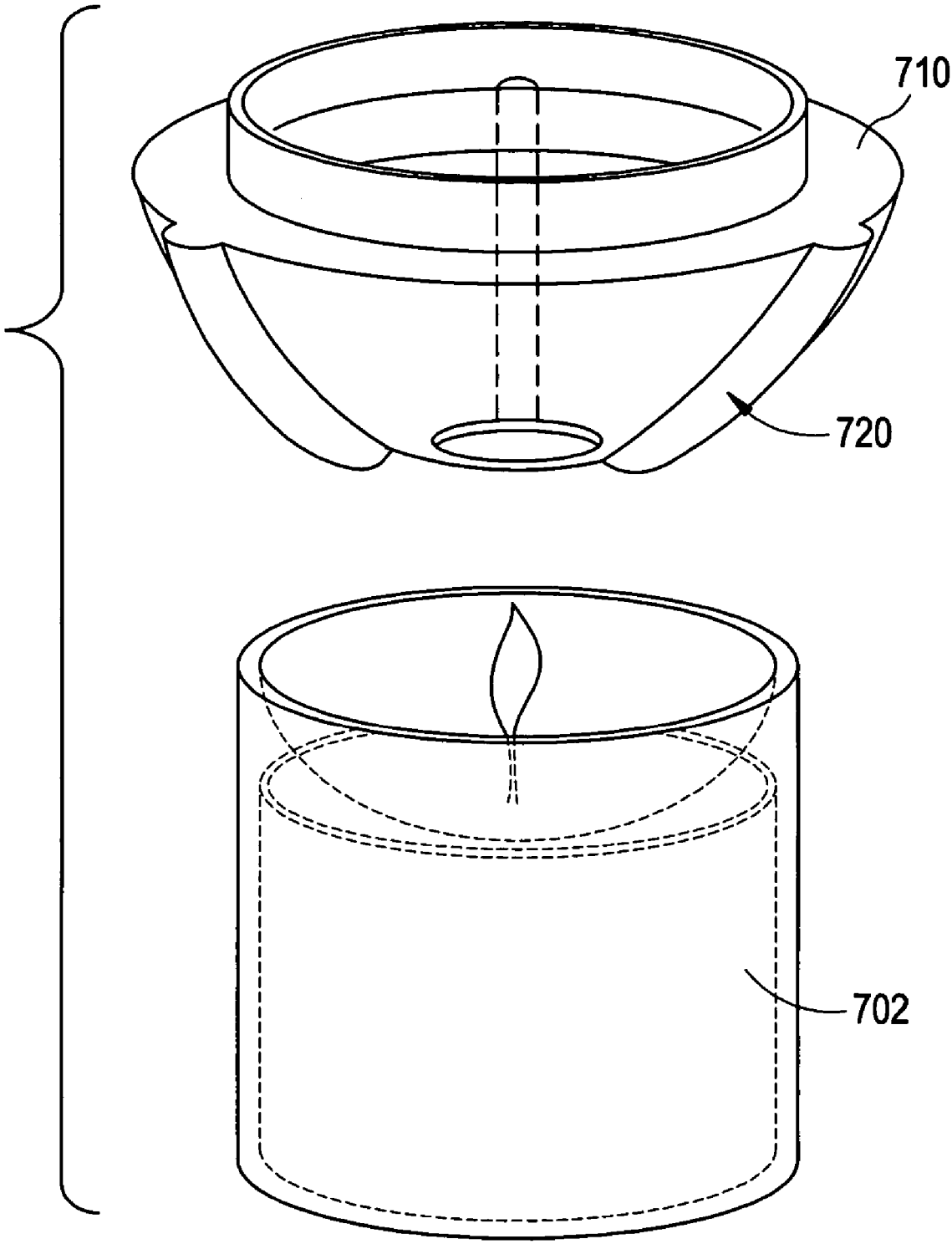
FIG. 28 is a view of another embodiment of the burn control cover of the present invention.

In another embodiment of the invention shown in FIG. 28, the burn control cover 710 includes standoff ribs 720 on the top surface. The burn control cover 710 may be inverted so that the top surface faces the holder 702. The standoff ribs 720 create air intake vents.

It will be appreciated that various embodiments are attainable. One skilled in the art will understand that the present invention can be practiced by combining one or more of the features of one of the embodiments with one or more of the features of a different embodiment.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A candle container comprising:

a holder having a bottom wall with an integrated upstanding wall defining an inner container volume which is configured to be substantially air tight and sealed but for an open top defined by a top rim edge of the upstanding wall;

a burn control cover including a top surface with an exhaust hole formed therein, a lower rim edge configured to removably attach to the top rim edge of the holder and a lower ring extending vertically down from an interior surface of the burn control cover and extending below the top rim edge of the holder; and a fitment removably attached to the burn control cover, the fitment being positioned between the lower ring of the burn control cover and the top rim edge of the holder such that the fitment contacts a portion of the lower ring and a portion of the top rim edge, wherein the fitment is configured to seal the candle container between the holder with the burn control cover;

wherein the burn control cover and holder are configured to vent air into the holder along a circumference of the lower rim edge.

2. A candle container of claim 1, wherein the exhaust hole extends through a center portion of the burn control cover.

3. A candle container of claim 1, wherein the burn control cover includes a second exhaust hole.

4. A candle container of claim 1, wherein the fitment attaches to the burn control cover through the exhaust hole by an undercut formed on the interior surface of the burn control cover, the fitment including an outer rim in a shape corresponding to the rim of the burn control cover.

5. A candle container of claim 1, further comprising a candle positioned inside the holder.

6. A candle container of claim 1, wherein the burn control cover includes: protrusions extending down in a vertical direction from the rim of the burn control cover; and the holder includes a plurality of corresponding notches in the top rim of the holder that vary in depth to allow the protrusions sit in the notches.

7. A candle container according to claim 6, wherein a first notch is configured to be shallower than a second notch.

8. A candle container according to claim 1, wherein the lower rim edge of the burn control cover includes peaks and troughs that define air intake vents in the lower rim edge of the burn control cover whereby air may flow through the air intake vents into the holder.

9. A candle container according to claim 1, wherein the top rim edge of the holder includes peaks and troughs that define air intake vents in the top rim edge of the holder whereby air may flow through the air intake vents into the holder.

10. A candle container according to claim 9, wherein the fitment has an outer rim in a shape corresponding to the rim of the holder.

11. A candle container according to claim 10, wherein the fitment attaches to the burn control cover through the exhaust hole by an undercut formed on an interior surface of the burn control cover.

12. A candle container according to claim 1, wherein the holder is made of glass.

13. A candle container of claim 1, wherein the burn control cover includes a plurality of standoff tabs positioned on an underside of the rim of the burn control cover.

14. A candle container of claim 13, wherein the standoff tabs are configured to be a wedge shape.

15. A candle container of claim 13, wherein the standoff tabs are configured to include a raised shoulder for aligning the burn control cover on the holder.

16. A candle container of claim 13, wherein the fitment includes notches positioned to clear the standoff tabs when the fitment is attached to the burn control cover.

17. A candle container of claim 1, further including an undercut lip on the lower ring for attaching the fitment to the burn control cover.

18. A fitment according to claim 1, further including a handle protruding from the fitment, wherein the handle may be gripped by a user for removing the fitment from the candle container.

19. A fitment according to claim 1, further including undercut lugs configured to lock the fitment to a burn control cover.

20. A fitment according to claim 1, further including a thinned section for removing the fitment.

21. A fitment according to claim 1, further including a void in the side wall of the fitment to vent displaced air when the fitment is attached to a candle container.

22. A fitment according to claim 1, further including fins on the side wall of the fitment configured to seal a candle container.

23. A candle container comprising:

a holder having a bottom wall with an integrated upstanding wall defining an inner container volume which is configured to be substantially air tight and sealed but for an open top defined by a top rim edge of the upstanding wall; and a burn control cover including a top surface with an exhaust hole formed therein; a lower rim edge extending along a circumference of the burn control cover and configured to removably attach to the top rim edge of the holder; and a lower ring extending vertically down from an interior surface of the burn control cover and extending below the top rim edge of the holder when the burn control cover is attached to the holder;

wherein the lower rim edge of the burn control cover further includes peaks and troughs defining air intake vents between the burn control cover and holder which are configured to vent air into the holder of the candle container.

24. A candle container of claim 23, wherein the exhaust hole extends through a center portion of the burn control cover.

25. A candle container according to claim 23, wherein the holder is made of glass.

* * * * *